US005350115A

United States Patent [19]

Burnworth et al.

[11] Patent Number: 5,350,115

[45] Date of Patent: Sep. 27, 1994

[54] LAWN SPRINKLER WITH CAM-CONTROLLED VARIABLE SPRAY PATTERN

[75] Inventors: Douglas J. Burnworth, Confluence, Pa.; Joachim H. Lungershausen, Stuttgart, Fed. Rep. of Germany

[73] Assignee: Vermont American Corporation, Louisville, Ky.

[21] Appl. No.: 101,651

[22] Filed: Aug. 10, 1993

[51] Int. Cl.[5] ..... B05B 3/16

[52] U.S. Cl. ..... 239/242; 239/246; 239/447; 239/563; 239/DIG. 1

[58] Field of Search ..... 239/242, 246, 275, 273, 239/447, 446, 563, 566, DIG. 1

[56] References Cited

U.S. PATENT DOCUMENTS

| | | | |
|---|---|---|---|
| 1,517,664 | 12/1924 | Bergquist | 239/242 |
| 2,869,630 | 1/1959 | Flynn | 239/447 X |
| 3,332,624 | 7/1967 | Rinkewich | 239/242 |
| 3,423,024 | 1/1969 | Morawetz | 239/242 |
| 3,647,140 | 3/1972 | Perrot et al. | 239/242 |
| 4,417,691 | 11/1983 | Lockwood | 239/DIG. 1 X |
| 4,568,023 | 2/1986 | Hayes | 239/242 |
| 4,721,248 | 1/1988 | Chow | 239/242 |
| 5,042,719 | 8/1991 | Magris et al. | 239/242 |
| 5,052,621 | 10/1991 | Katzer et al. | 239/242 |
| 5,052,622 | 10/1991 | Lindermeir et al. | 239/242 |

FOREIGN PATENT DOCUMENTS

| | | | |
|---|---|---|---|
| 3119094 | 11/1982 | Fed. Rep. of Germany | 239/242 |

*Primary Examiner*—Andres Kashnikow
*Assistant Examiner*—Lesley D. Morris
*Attorney, Agent, or Firm*—Middleton & Reutlinger

[57] ABSTRACT

An oscillating sprinkler adjustable to selectively alter and adjust the spray pattern as desired is provided. Adjustment is provided by an internal selectable cam connected to an external rotary dial at the distal end of the sprinkler. Placing the spray adjustment dial at the distal (non-hose) end of the sprinkler minimizes the chances of the operator getting wet while selecting the desired spray pattern while the sprinkler is in operation.

26 Claims, 11 Drawing Sheets

LAWN SPRINKLER WITH CAM-CONTROLLED VARIABLE SPRAY PATTERN

BACKGROUND OF THE INVENTION

This invention relates to lawn and garden sprinklers, more particularly oscillating sprinklers.

Sprinklers have been used for many years to provide sufficient moisture upon a surface, such as a lawn comprised of grass, to ensure that plants growing on such surface have sufficient irrigation to support healthy growth and prevent disease or even dying. In recent years, oscillating sprinklers, such as U.S. Pat. Nos. 3,332,624, 4,721,248 and 4,568,023 have been developed to provide a more uniform spray pattern over a more or less rectangular area. Such oscillating sprinklers are usually driven by a "water motor" or the like, such as is disclosed in U.S. Pat. No. 4,417,691 or 5,052,621.

A continuing problem has been to provide a sprinkler, particularly an oscillating sprinkler, with a spray pattern that can cover different sized areas uniformly. Because an oscillating sprinkler typically delivers a spray pattern that is more or less rectangular, it is difficult to provide uniform moisture over an irregular shaped surface. In placing the oscillating sprinkler at differing locations necessary to cover an irregularly shaped lawn surface, it often occurs that the rectangular spray pattern will "overlap," causing some areas of the lawn surface to receive more irrigation than others.

The prior art discloses some efforts to provide a variable spray pattern. U.S. Pat. No. 3,423,024 teaches the use of a plurality of external restrictors in the form of a thumb wheel, each with a blocking valve element which may be maneuvered over the outside of a spray orifice, or water jet, to partially prevent water from exiting therefrom. U.S. Pat. No. 5,052,622 teaches the use of external individually operable check valves to block water flow to selected water jets. These devices are less than desirable in operation, the former because the valve elements are less than effective in blocking water flow from outside the spray nozzle of the water jets, and the latter because the check valves have to be individually manipulated, and are difficult to operate while the sprinkler is in use, often resulting in the operator getting wet while attempting to alter the spray pattern.

The present invention solves these problems by providing a novel cam-operated selector in cooperation with a plurality of water interruption plunger assemblies to open or close selected water jets. Thus, using the present invention the user can "dial in" a wide variety of spray patterns to cover a correspondingly wide variety of areas, all without risk of getting wet.

SUMMARY OF THE INVENTION

It is, therefore, an object of the present invention to provide an oscillating sprinkler with an easily operable means to selectively alter and adjust the spray pattern as desired.

It is a further object of the present invention to provide such adjustments by means of an internal selectable cam connected to an external rotary dial at the distal end of the sprinkler.

It is a further object of the present invention to place the spray adjustment means at the distal (non-hose) end of the sprinkler, which minimizes the chances of the operator getting wet while accomplishing the foregoing objectives to achieve the desired spray pattern while the sprinkler is in operation.

The foregoing objects are accomplished, as described in more detail hereinafter, by providing a novel cam shaft having a plurality of cam surfaces thereon in cooperation with a corresponding plurality of rotatable water interruption plunger assemblies in the internal water tube of the sprinkler. The cam shaft is connected at its distal end to an externally mounted dial, which in turn is mounted upon the distal end of the water tube housing of the sprinkler and rotatable independent thereof. By rotating the rotary cam dial, this causes the cam shaft and cam surfaces to rotate correspondingly. Upon the cam shaft, there are mounted a plurality of normally-open water interruption plunger assemblies or stoppers which cooperate with each corresponding cam surface, and which are each in rotational alignment with a selected water jet. When a plunger assembly is contacted by a cam surface, it is urged into and out of contact with its aligned water jet, thereby selectably interrupting or permitting water flow to the orifice of that water jet. The cam surfaces are selectively arranged around the periphery of the cam shaft, so that at different degrees of rotation, different selected plungers/stoppers are either open or closed, depending upon the rotational position of the camshaft, which in turn is determined by the rotational position of the external rotary dial.

It has been found advantageous to provide a "constantly on" portion in the central portion of the spray tube of an oscillating sprinkler, and to provide the adjustable water jets at either the proximal or distal ends (or both as shown hereinafter in the preferred embodiment) of the spray tube of an oscillating sprinkler.

More particularly, it is an object of the present invention to provide an oscillating sprinkler having an elongated housing in the form of a tubing having an elongated slot in the top surface thereof, a water tube extending within the elongated housing having a plurality of orifices in alignment with the top slot, a cam shaft extending longitudinally of and disposed within the water tube which cam shaft includes a plurality of rotatable plungers therealong in communication with the cam shaft for selectably interrupting water flow to one or more of the orifices, means such as a turbine type water motor to rotate the cam shaft, means to oscillate the elongated housing, and means to add water to the water tube and water motor.

A particular arrangement of selectably variable spray pattern for an oscillating sprinkler is disclosed hereinafter in the Detailed Description of the Preferred Embodiment. Of course, those skilled in the art can appreciate that the principles of the present invention are applicable to a wide variety of usages, and are not restricted to operation in an oscillating sprinkler. Those skilled in the art can also appreciate that an infinite variety of cam-controlled spray patterns is achievable using the present invention, ranging from all water jets open, to certain closed, to all closed, all without departing from the spirit or scope of the present invention and the appended claims.

DETAILED DESCRIPTION OF THE PREFERRED EMBODIMENT

Figure 1:
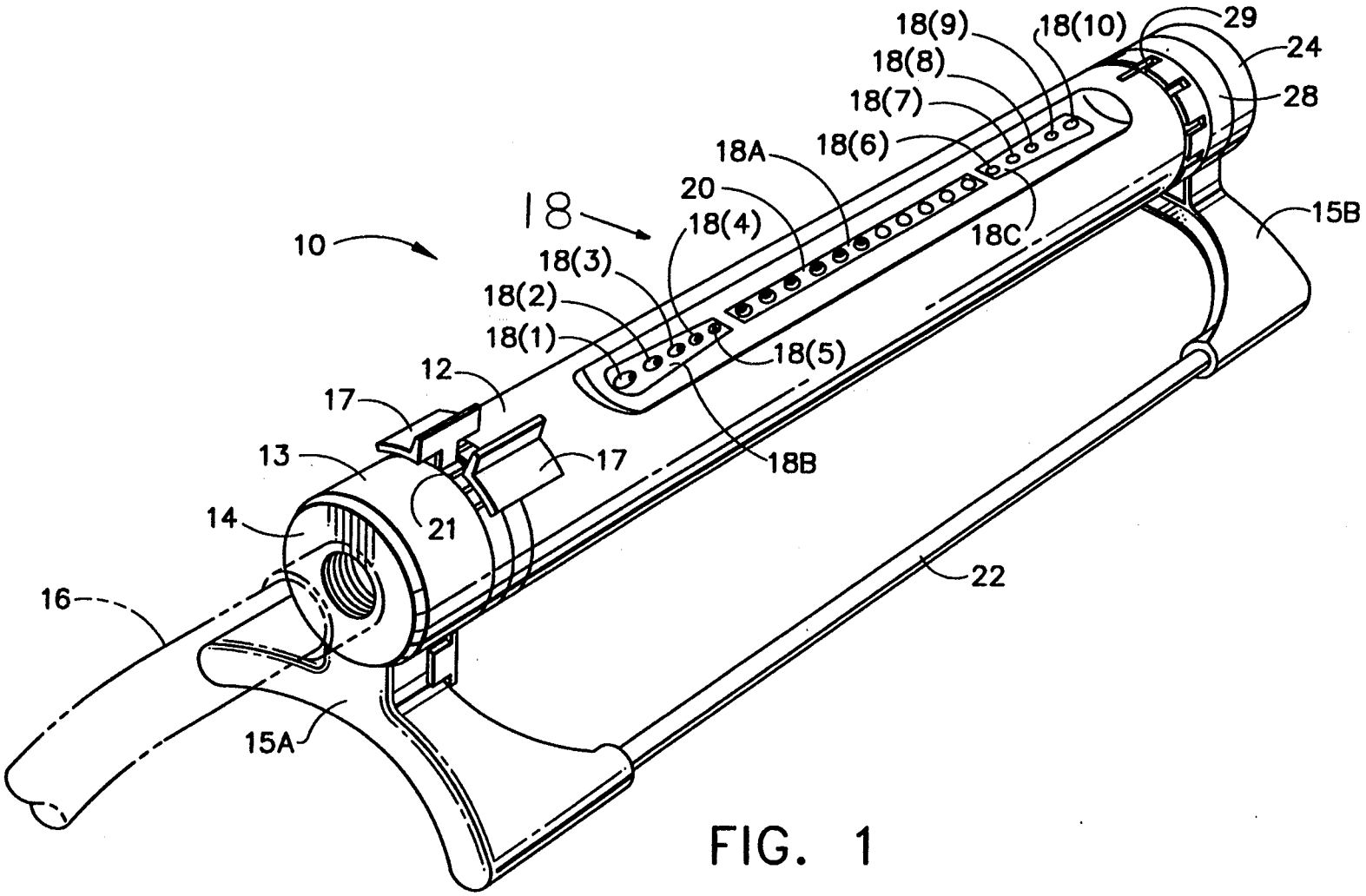
FIG. 1 is a perspective view of an oscillating sprinkler utilizing the present invention.
Figure 3A:
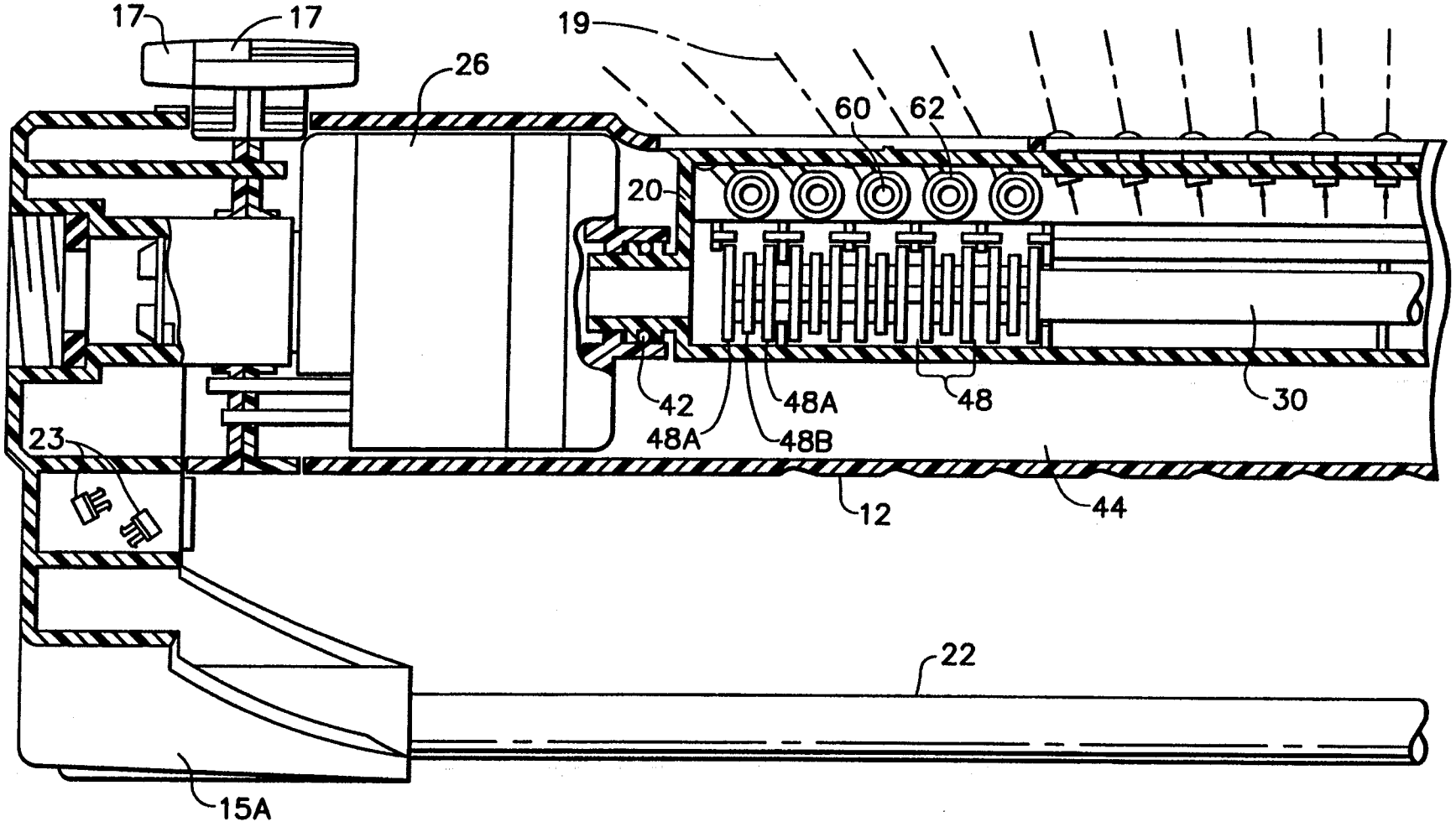
FIG. 3A is a cross section, taken along line 3A of FIG. 2, of the proximal (water motor) end of the sprinkler.

Referring now to FIG. 1, there is disclosed an oscillating sprinkler 10, having an elongated generally tubular-shaped outer casing 12. Outer casing 12 is generally suspended between a pair of support members, proximal support member 15A and distal support member 15B, which are connected for stability by a pair of connecting members 22. Casing 12 is operably connectable at its proximal or water inlet end 14 to a housing 13 which is formed in the upper portion of a proximal support member 15A. The inlet end 14 of proximal support member 15A contains fittings to receive a fluid-carrying device 16, such as a garden hose. The distal end of the outer casing 12 of sprinkler 10 is operably connectable to distal support member 15B in the manner set forth in FIG. 3B and FIG. 5, a manner which is generally known. The interior of housing 13 of proximal support member 15A contains a water motor 26 (see, FIG. 3A) of the turbine variety which imparts the oscillating motion to casing 12, by a series of gears in connection with the water turbine (not shown) in a manner generally known. Housing 13 is also equipped with thumb operated adjusting knobs 17, which are employed to selectively vary the degree of oscillation, in a manner generally known. The degree of oscillation can be "marked" with markers 23 which fit into slots 21 in housing 13. In this way, once a desired oscillation pattern is achieved for a particular area, markers 23 can be inserted into the appropriate slots 21 so that the same oscillation pattern can be "dialed in" by adjusting thumb adjustments 17 to match the position of markers 23.

Outer casing 12 receives a water tube 20 which is also suspended between support members 15A and 15B. Casing 12 does not carry any of the weight of water tube 20, and water tube 20 does not support any weight of casing 12. Water tube 20 is provided with a plurality of water jets 18 which emit water spray 19 therefrom to provide the desired irrigation. In the particular arrangement of water jets 18 described hereinafter, the 11 central water jets in area 18A remain in fluid contact all the time, so there is always spray 19 emitting therefrom when water supply is fed from hose 16 into inlet end 14 of housing 13. The five proximal end water jets in area 18B and the five distal water jets in area 18C are selectively operable in the manner hereinafter described, thereby permitting a selectively variable spray pattern. Also, the water jets 18 of the present invention are arranged at different selected angles, to provide maximum area coverage of the spray 19 emitted from water jets 18.

Figure 3B:
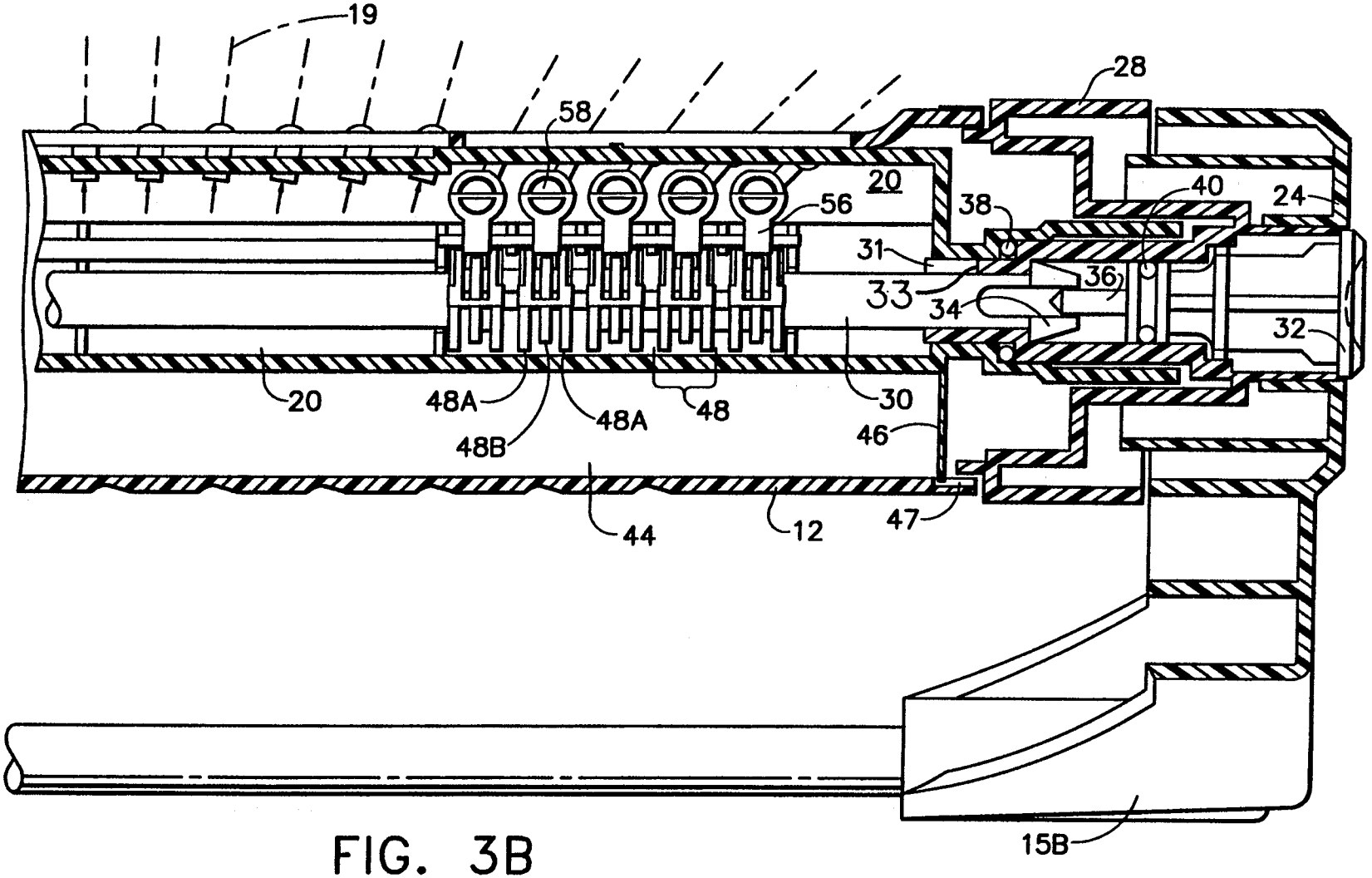
FIG. 3B is a cross section, taken along line 3B of FIG. 2, of the distal (rotary dial) end of the sprinkler.
Figure 4:
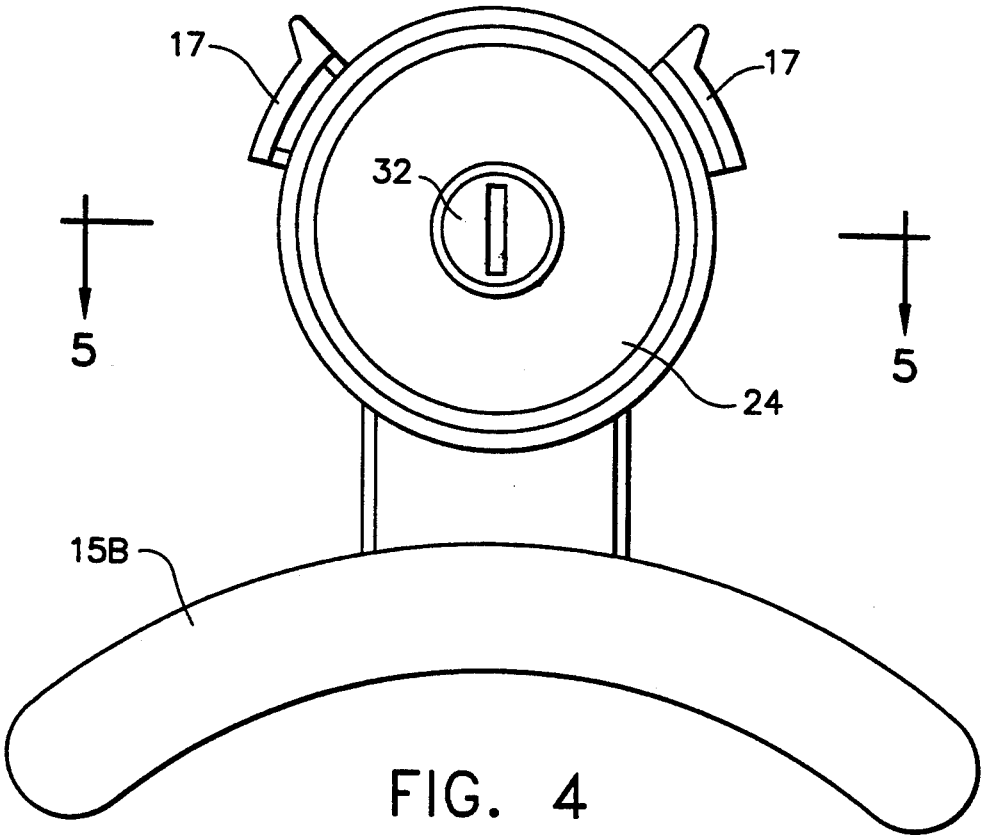
FIG. 4 is a distal end view of the sprinkler of FIG. 1.
Figure 5:
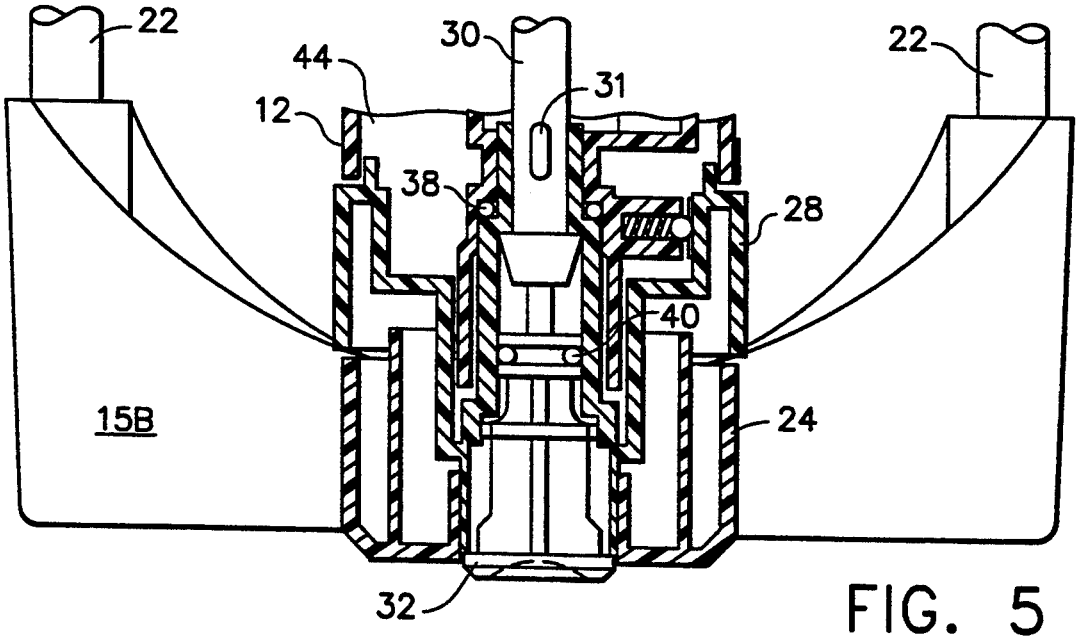
FIG. 5 is a cross section, taken along line 5 of FIG. 4, of the distal end of the sprinkler.
Figure 8:
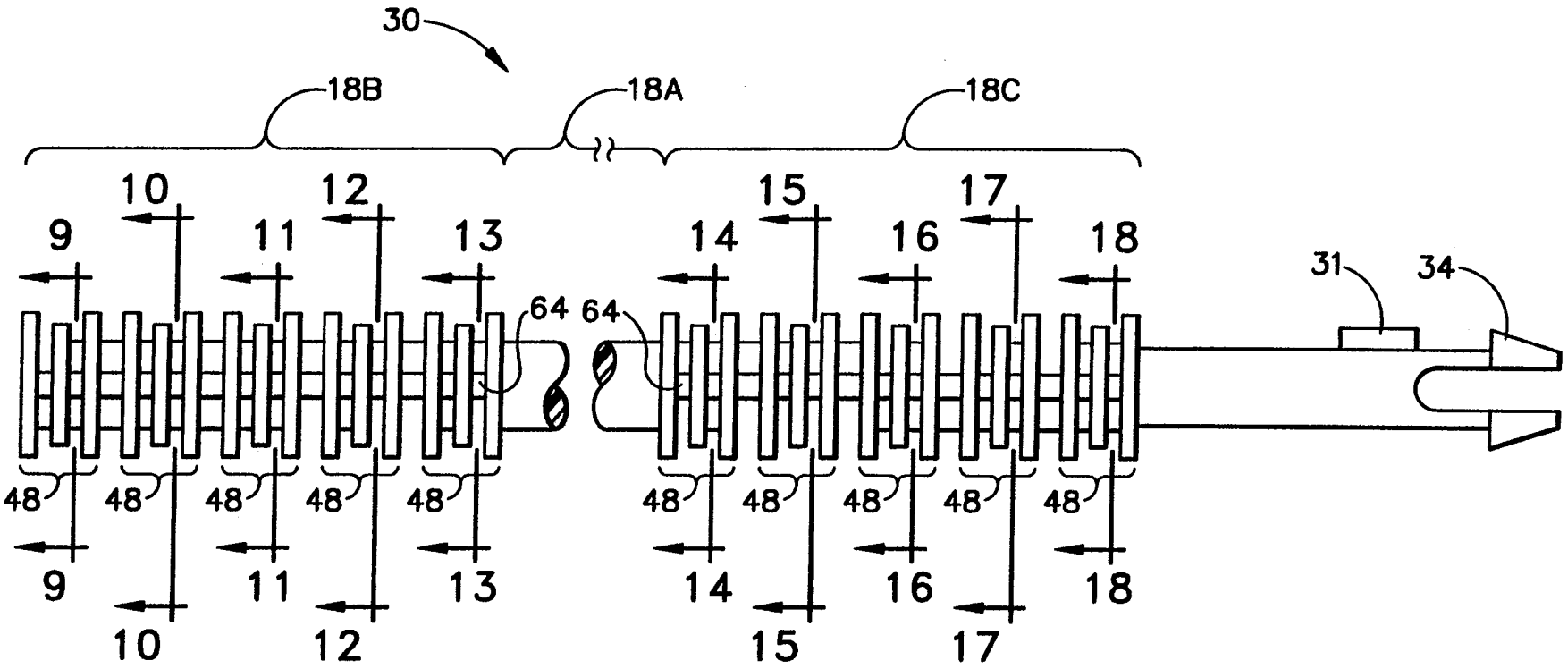
FIG. 8 is a plan view of the cam shaft and cam surfaces of the present invention.

The upper region of distal support member 15B contains an upper portion in the form of a housing 24 to receive the distal end of cam shaft 30 (see. FIGS. 3B, 5 and 8). Cam shaft 30 is also operably connected to a cam adjustment dial 28 which is water-sealed separate from casing 12 (and water tube 20) and also freely rotatable independent of casing 12. Rotating cam adjustment dial 28 causes cam shaft 30 to be rotated on a 1:1 basis, causing water jets in area 18B and/or in area 18C to be selectively operable in the manner hereinafter described. Marker pieces 23 can be inserted into slots 29 of cam dial 28 after achieving a desired spray pattern, in a manner similar to that described above after a desired oscillating pattern is achieved.

Housing 24 is provided with a removable end plug 32 which provides access to the interior thereof for cleaning purposes and the like. End plug 32 is connectable to cam shaft means 30 at their respective distal ends 36, 34, but such connection does not affect the operation of cam dial 28. Cam shaft 30 is maintained in proper alignment with cam dial 28 by a projecting fin or detent 31 thereon which fits into a corresponding slot 33 of cam dial 28 which in turn is received in concentric relationship by housing 24; this ensures that the operation of cam shaft 30 by cam dial 28 always begins from a known radial position, resulting in a predictable and programmed engagement or disengagement of water jets 18 (see, FIG. 19).

It is also seen that by the use of watertight seals 40, the connection of cam shaft 30 to end plug 32 is not immersed. Similarly, by using watertight seals 42 at the outlet end of water motor 26, water is directed only into water tube 20, and the inner space 44 of casing 12 which surrounds water tube 20 is maintained dry. As shown in FIG. 3B, water tube 20 is guided into proper radial alignment with water motor 26 and cam dial 28 within casing 12 by an alignment member 46 at its right portion, which fits into an alignment slot 47 at the right (distal) end of casing 12.

Figure 6A:
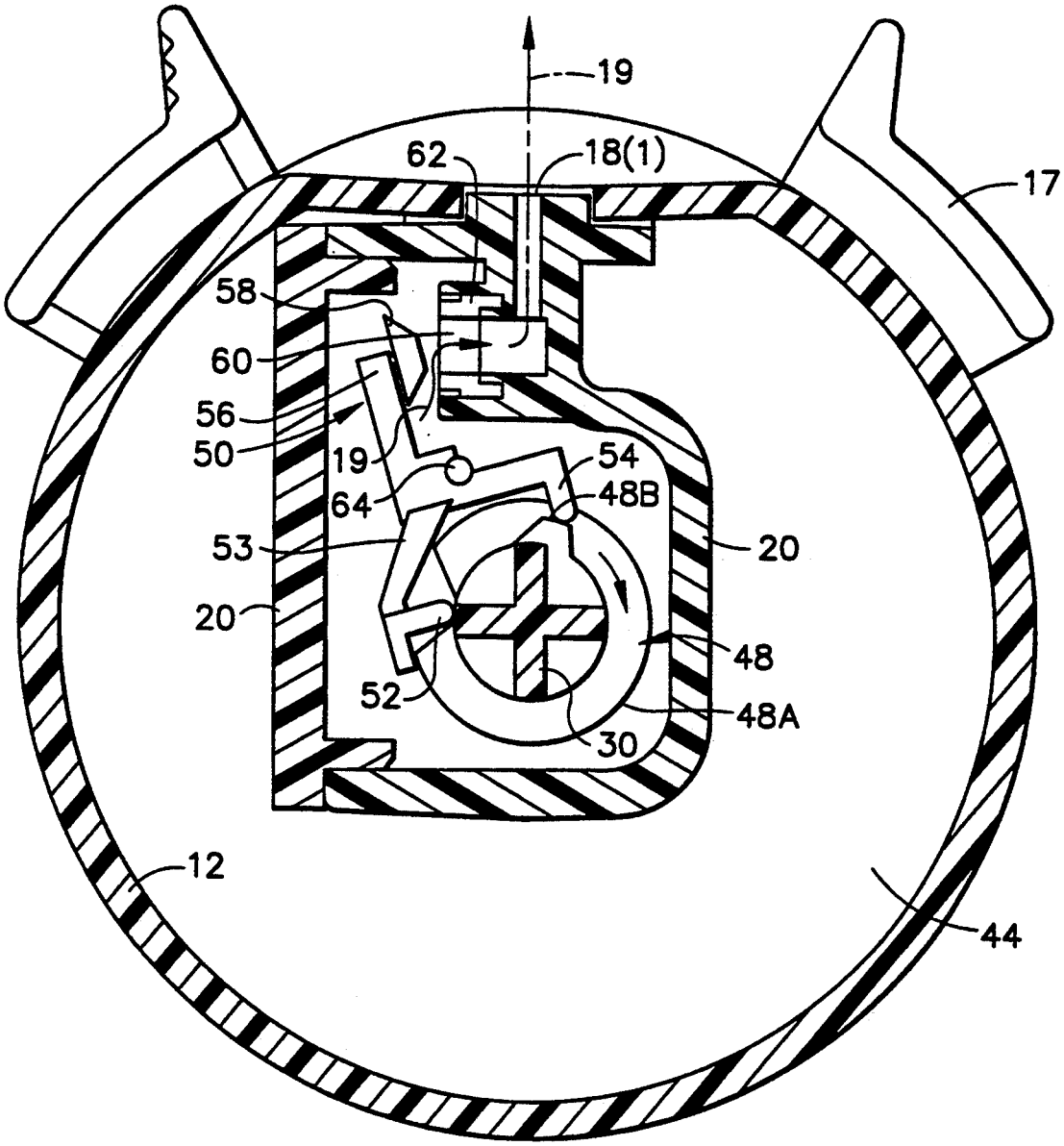
FIG. 6A is a cross section, taken along line 6A of FIG. 2, showing a cam and plunger in "open" position.
Figure 6B:
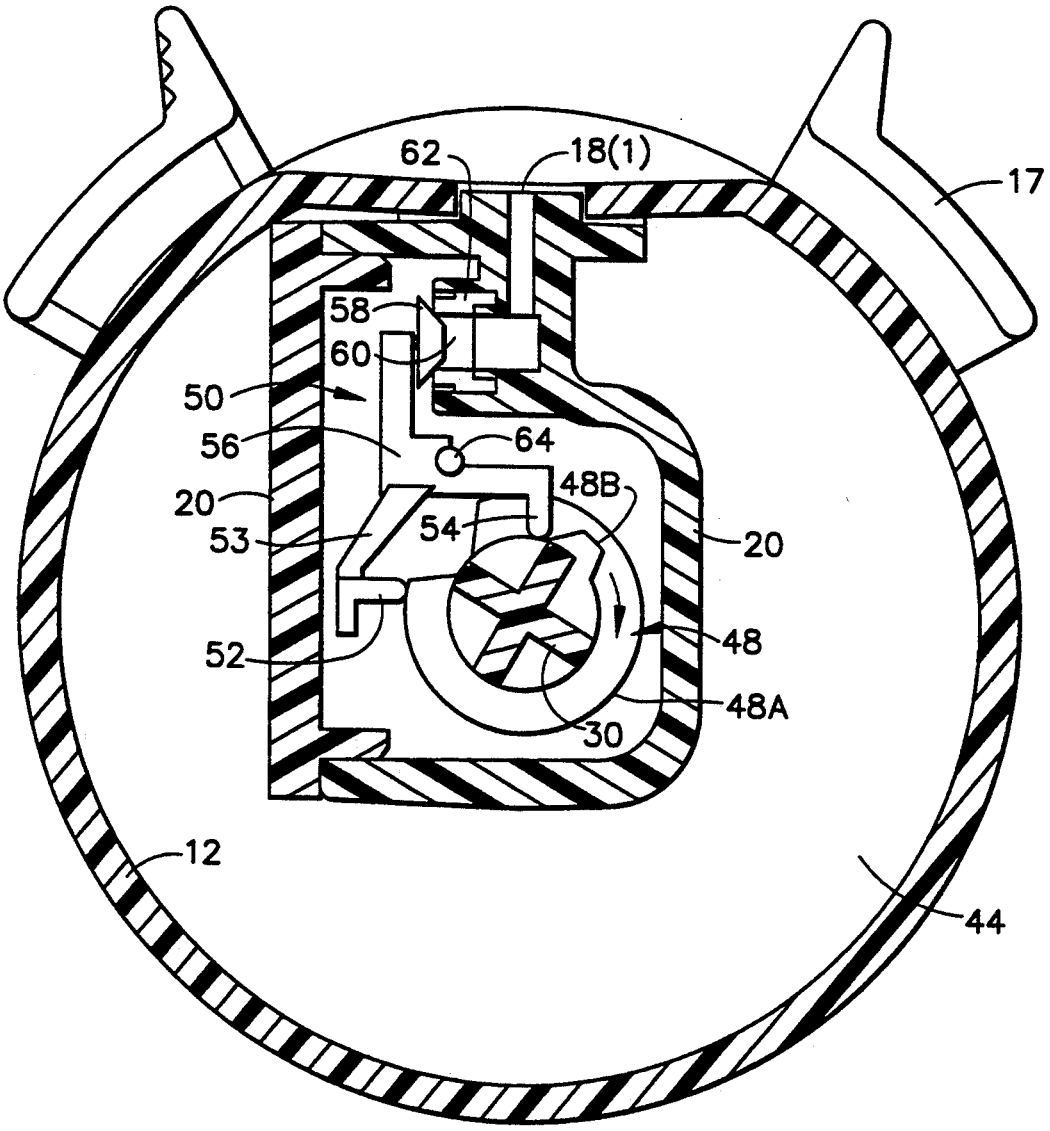
FIG. 6B is a cross section, taken along line 6B of FIG. 2, showing a cam and plunger in "closed" position.
Figure 7:
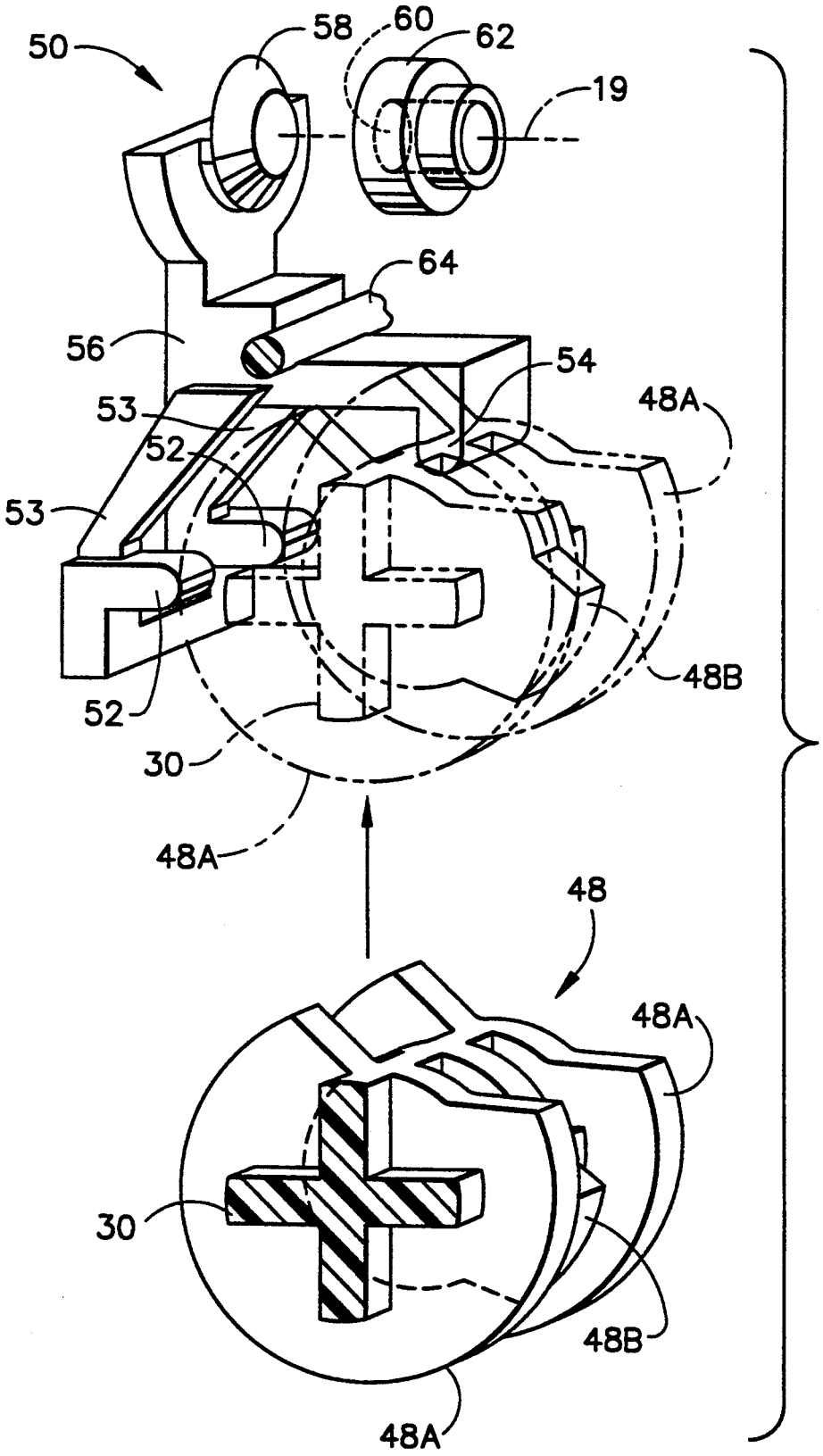
FIG. 7 is an isolated perspective view showing detail of the cooperation between the cam shaft and plungers and orifices of the water jets of the present invention.

Referring now to FIGS. 6A, 6B, 7 and 8, the manner which the cam shaft 30 engages or disengages water flow to water jets 18 is revealed. Cam shaft 30 is provided with a plurality of cam surfaces 48 arranged in tripartite fashion (see FIG. 7) and a plurality of water interruption means in communication therewith. Each tripartite set of cam surfaces is aligned with a selected water jet 18 and is further provided with a corresponding water interruption means in the form of water interruption plunger or stopper assembly 50, each of which is aligned with a selected water jet 18. The plurality of water interruption plunger assemblies 50 are connected to and disposed around a central shaft 64 which extends above and parallel to the longitudinal axis of cam shaft 30. Shaft 64 is fixed at its ends to maintain the position of each water interruption plunger assembly 50 in relation to its corresponding cam surface 48. Each water interruption plunger or stopper assembly 50 is provided at its lower portion with two spaced apart cam-following legs 52 connected via struts 53 to a higher positioned center cam-following leg 54 disposed forward of and between the spaced-apart lower legs 52. The spaced apart cam-following legs 52 engage the outer cam surfaces 48A of tripartite cam surface 48, and central cam-following leg 54 engages the central cam surface 48B of cam surface. Spaced-apart legs 52 and central leg 54 are in turn connected to neck portion 56 which is provided with a flared stopper 58. Each flared stopper 58 is engageable with a corresponding orifice 60 formed in the upper region of water tube 20. Each orifice 60 is surrounded by a water tight gasket 62 (see also FIG. 3A) so that when flared stopper 58 of water interruption plunger assembly 50 is urged by the communication of legs 52 with cam surface 48A into engagement with orifice 60, a watertight seal is formed, thereby eliminating water flow into orifice 60 and out water jet 18. In FIG. 6A, central leg 54 of water interruption plunger assembly 50 is in contact with the raised portion of center cam surface 48B and spaced-apart legs 52 are in contact with the non-raised portions of outer cam surfaces 48A, which causes water interruption plunger assembly 50 to rotate about rotation axis means 64 and pull flared stopper 58 away from contact with orifice 60, thereby permitting water 19 to flow therethrough and out water jet 18(1). In FIG. 6B, central leg 54 of water interruption plunger assembly 50 is not in contact with the raised portion of center cam surface 48B while space-apart legs 52 are in contact with the raised portions of outer cam surfaces 48A, which causes water interruption plunger assembly 50 to rotate forward about rotation axis 64, thereby urging flared stopper 58 into contact with orifice 60 and gasket 62, fully interrupting water flow to the particular water jet 18(1).

It is seen that by varying the peripheral length of the raised portions of cam surfaces 48A, 48B, water interruption plunger assembly 50 may be programmed to be in contact with or not in contact with orifice 60. In this fashion, by selectively placing varying length raised cam surfaces 48A, 48B on cam shaft 30, camshaft 30 may be rotated by cam dial 28 or end plug 32 to provide a selected variety of open or closed water jets 18 in areas 18B and/or 18C, and that this in turn determines the spray pattern of the water 19 emitted from water jets 18. Thus, an operator can "dial in" a selected spray pattern by rotating the cam shaft to achieve the desired open or closed status of water jets 18 in areas 18B and/or 18C.

Referring now to FIGS. 9—18 and 19, a particular arrangement of cam surfaces 48 on cam shaft 30 is shown which results in one particular set of selectable spray patterns. FIGS. 9—13 show the cam surface arrangement to control the status of water jets 18 in area 18B (shown in FIGS. 1 and 2 as water jets 18(1), 18(2), 18(3), 18(4) and 18(5)), and FIGS. 14—18 show the cam surface arrangement to control the status (open or closed) of water jets 18 in area 18C (shown in FIGS. 1 and 2 as water jets 18(6), 18(7), 18(8), 18(9) and 18(10)). In this particular arrangement, the water jets 18 in area 18A are always open and operating.

Figure 2:
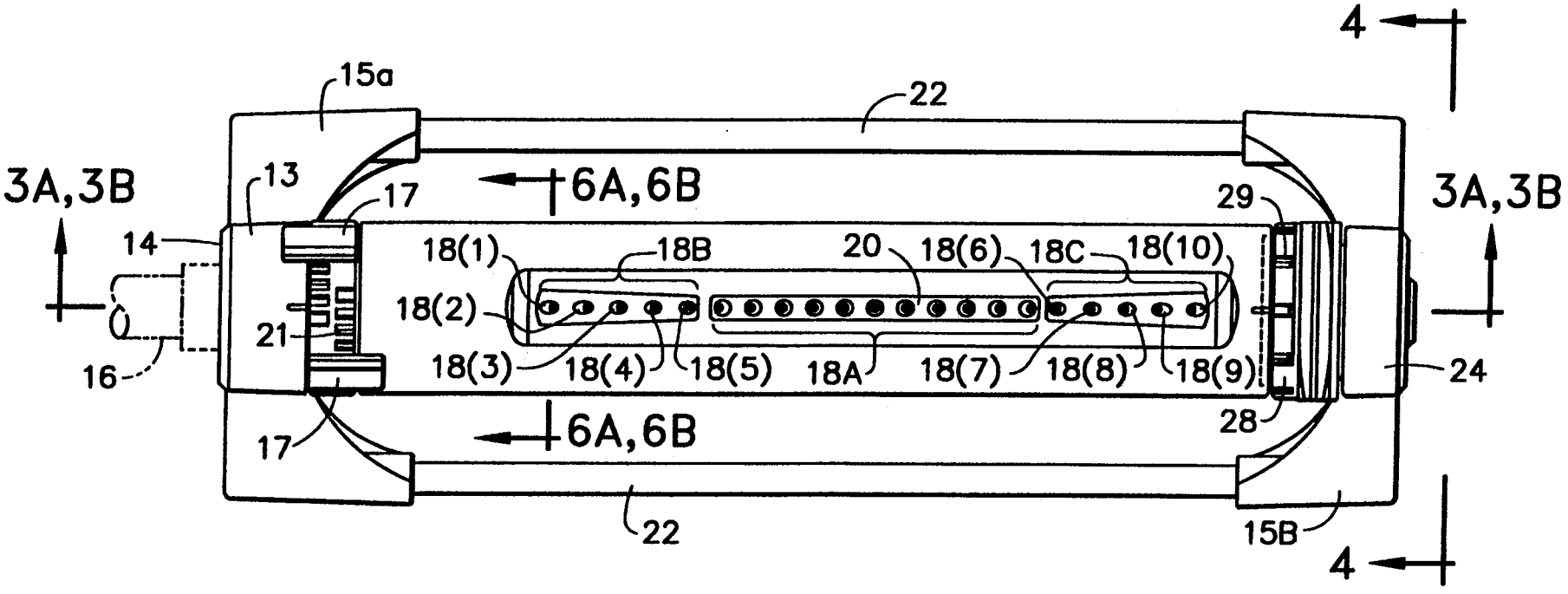
FIG. 2 is a top view of the sprinkler shown in FIG. 1.
Figure 9:
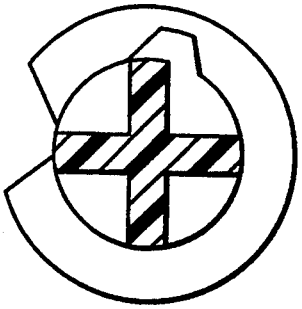
FIGS. 9–18 are cross sections of the cam shaft and cam surfaces of the present invention taken along the corresponding lines of FIG. 8.
Figure 10:
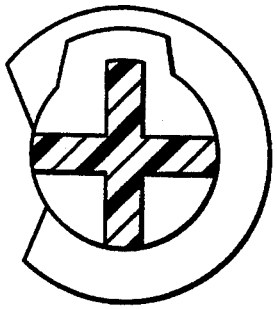
Figure 11:
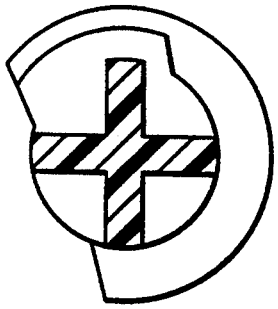
Figure 12:
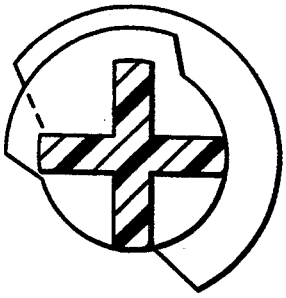
Figure 13:
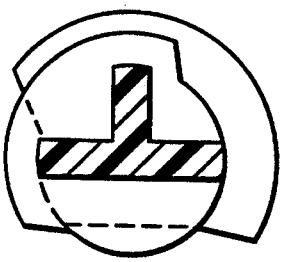
Figure 14:
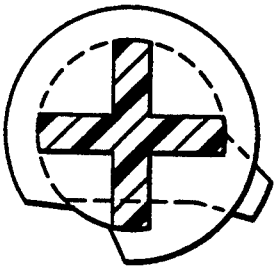
Figure 15:
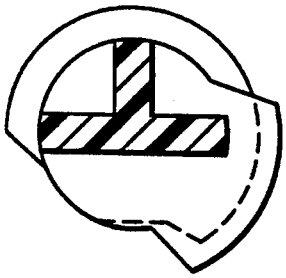
Figure 16:
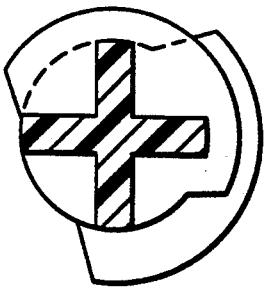
Figure 17:
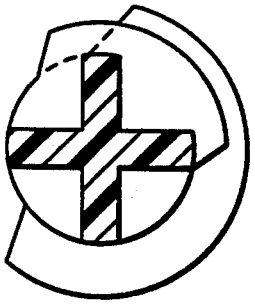
Figure 18:
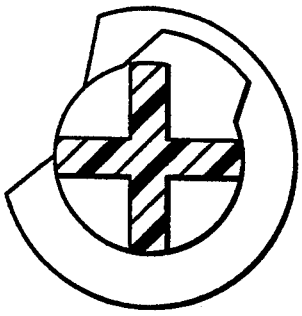

Referring to water jet grouping 18B of FIGS. 1 and 2, FIG. 9 is the cam surface relating to water jet 18(1), FIG. 10 to water jet 18(2), FIG. 11 to water jet 18(3), FIG. 12 to water jet 18(4) and FIG. 13 to water jet 18(5). Referring to water jet grouping 18C of FIGS. 1 and 2, FIG. 14 is the cam surface relating to water jet 18(6), FIG. 15 to water jet 18(7), FIG. 16 to water jet 18(8), FIG. 17 to water jet 18(9) and FIG. 18 to water jet 18(10).

Figure 19:
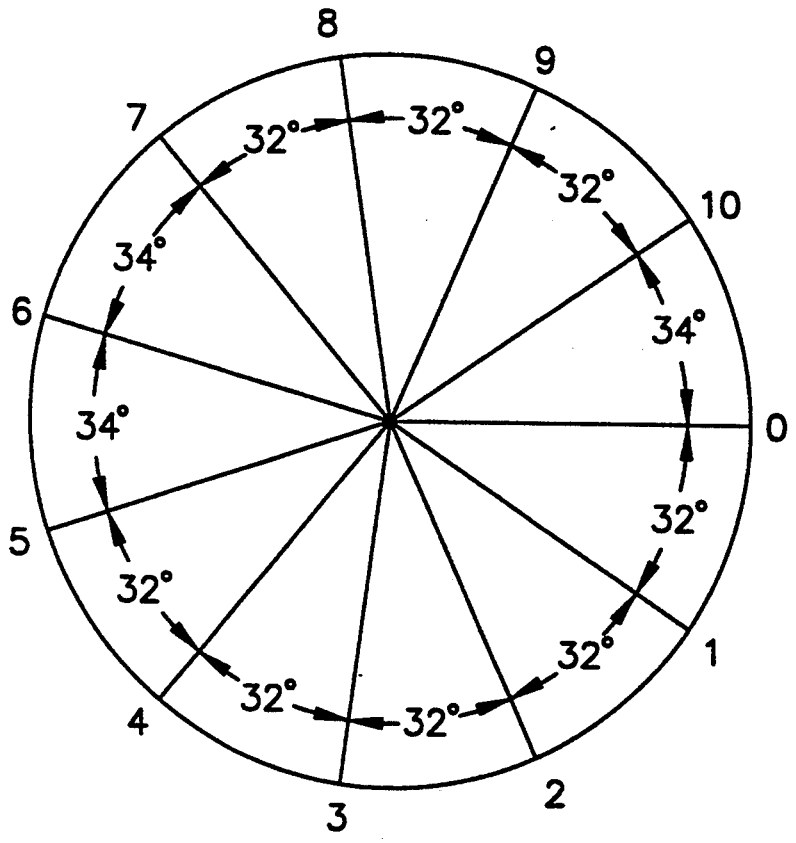
FIG. 19 is a geometric representation of the water jet status at differing rotational positions of the cam shaft of FIG. 8.

Referring to FIG. 19, this shows how the different water jets 18 of water jet groupings 18B and 18C will be actuated by rotating cam dial 28. When cam dial is aligned coincident with the fin or detent 31 of camshaft 30 (the "zero" position), all water jets 18 (1) through 18(10) are open or "on," which is to say that each flared stepper 58 of each water interruption plunger assembly 50 is disengaged from each orifice 60, as shown in FIG. 6A. As cam dial 28 is rotated clockwise through its eleven sequential positions (each rotational position being approximately a 32 degree radial rotation of cam dial 28), FIG. 19 shows how the different water jets are affected by this particular cam arrangement.

Positions past the detent of zero position will be referred to as "position 1," "position 2" on so on until "position 10," the last position clockwise past the zero position. In position 1 (first position clockwise past the detent or "zero" position), all water jets in area 18B are closed (water jets 18(1), 18(2), 18(3), 18(4) and 18(5) as shown in FIGS. 1 and 2), which is to say that flared stopper 58 of water interruption plunger assembly 50 has been urged into engagement with orifice 60 and surrounding gasket 62 of the affected water jets. In position 2, water jets 18(1–5) of area 18B and water jet 18(10) of area 18C are closed. In the position 3, all water jets of area 18B and water jets 18(10) and 18(9) of area 18C are closed. In position 4, all water jets in area 18B and water jets 18(10), 18(9), and 18(8) in area 18C are off. In position 5, all water jets of area 18B and four of the five jets in area 18C (jets 18(10), 18(9), 18(8) and 18(7)) are off. In position 6, all water jets in both area 18B and area 18C are off, and (in this particular arrangement) water can emit only from the 11 water jets in area 18A.

In the positions 7 through 10, water jets are sequentially opened in pairs. In position 7, water jets 18(5) and 18(6) are opened (the inner-most water jets of area 18B and 18C respectively). In position 8, water jets 18(4) and 18(7) are opened in addition to water jets 18(5) and 18(6). In position 9, water jets 18(3) and 18(8) are opened in addition to water jets 18(4), 18(5), 18(6) and 18(7). In position 10, water jets 18(2) and 18(9) are additionally opened, leaving only the extreme outside water jet 18(1) of area 18B and water jet 18(10) of area 18C still off. Upon returning to the "zero" position, water jets 18(1) and 18(10) are opened, resulting in the most full spray pattern achievable by this particular camshaft arrangement.

The sprinkler 10 of the present invention may be manufactured using a variety of known materials, for example ABS thermoplastics such as polystyrene, polyethylene and the like, and using generally known techniques such as injection molding to make the individual components and sonic welding to join such components together.

I claim:

1. An oscillating water sprinkler comprising:

a water tube to carry water having a plurality of orifices in the top thereof;

a cam shaft extending longitudinally of and disposed within said water tube, said cam shaft including a plurality of rotatable plungers therealong, and a plurality of cam surfaces, said rotatable plungers being in cooperating relation with and movable in response to positioning of said cam surfaces to selectably permit or interrupt water flow to said orifices;

means to rotate said cam shaft;

means to oscillate said water tube; and means to add water to said water tube.

2. The water sprinkler of claim 1, further comprising an elongated casing surrounding said water tube, wherein said casing includes a slot in the top thereof, said plurality of orifices in said water tube being in alignment with said slot of said casing.

3. The water sprinkler of claim 2 wherein said orifices in said water tube are in at least two distinct sections of said tube, a first section containing a selected number of orifices which are in continuous flow communication with said means to add water to said water tube, and at least one other section containing a selected number of orifices which are in selectably interruptable flow communication with said means to add water to said water tube.

4. The water sprinkler of claim 2 wherein said orifices in said water tube are in three distinct sections of said tube, a first section containing a first selected number of orifices, a second section containing a second selected number of orifices, and a third section containing a third selected number of orifices, and wherein said plurality of rotatable plungers includes a first selected number of plungers in alignment with said first selected number of orifices and a second selected number of plungers in alignment with said third selected number of orifices.

5. The sprinkler of claim 4 wherein said second section of said water tube is in continuous flow communication with said means to add water to said water tube, and said first or said second section of said water tube contains orifices which are in selectably interruptable flow communication with said means to add water to said water tube.

6. The sprinkler of claim 4 wherein said second section of said water tube is in continuous flow communication with said means to add water to said water tube, and said first and said second section of said water tube contains orifices which are in selectably interruptable flow communication with said means to add water to said water tube.

7. The sprinkler of claim 1, wherein said plurality of orifices is arranged at varying spray angles with respect to the top surface of said water tube.

8. The sprinkler of claim 2, wherein said plurality of orifices is arranged at varying spray angles with respect to the top surface of said water tube.

9. The sprinkler of claim 1, wherein the configuration of said cam surfaces defines the engaging relationship between each water interruption plunger and its aligned orifice.

10. The sprinkler of claim 2, wherein the configuration of said cam surfaces defines the engaging relationship between each water interruption plunger and its aligned orifice.

11. The water sprinkler of claim 1, each of said plungers including a lower portion with two spaced-apart cam-following legs connected to a higher portion having a center cam-following leg disposed forward of and between said spaced-apart lower portion legs.

12. The water sprinkler of claim 2, each of said plungers including a lower portion with two spaced-apart cam-following legs connected to a higher portion having a center cam-following leg disposed forward of and between said spaced-apart lower portion legs.

13. The water sprinkler of claim 1, wherein said means to rotate said cam shaft is a cam dial disposed concentric and rotatable independently of said elongated water tube.

14. The water sprinkler of claim 2, wherein said means to rotate said cam shaft is a cam dial disposed concentric of and rotatable independently of said elongated casing and said water tube.

15. The water sprinkler of claim 1 including means to mark on said sprinkler a desired oscillating pattern.

16. The water sprinkler of claim 2 including means to mark on said sprinkler a desired oscillating pattern.

17. The water sprinkler of claim 1 including means to mark on said sprinkler a desired pattern of selected orifices open or closed.

18. The water sprinkler of claim 2 including means to mark on said sprinkler a desired pattern of selected orifices open or closed.

19. The water sprinkler of claim 1 including means to mark on said sprinkler a desired oscillating pattern and a desired pattern of selected orifices open or closed.

20. The water sprinkler of claim 2 including means to mark on said sprinkler a desired oscillating pattern and a desired pattern of selected orifices open or closed.

21. The sprinkler of claim 9, said cam surfaces being of different configurations along said cam shaft whereby at different selected rotatable positions of said cam shaft a spacing relation between said plungers and said orifices will vary according to said selected rotatable position and selected orifices are correspondingly open or closed.

22. The sprinkler of claim 10, said cam surfaces being of different configurations along said cam shaft whereby at different selected rotatable positions of said cam shaft a spacing relation between said plungers and said orifices will vary according to said selected rotatable position and selected orifices are correspondingly open or closed.

23. An oscillating water sprinkler comprising:

an elongated casing disposed between first and second support housings at either end of said casing, each support housing having a base portion and an upper portion concentric of said casing, and said casing having a generally longitudinal opening therein along the top surface thereof;

a water tube to carry water carried within said casing and connected to said upper portion of said first and second support housings at each end of said water tube, said water tube being in sealed relationship with a water motor so that water is directed only into said water tube and not into any other portion of said casing, said water tube having a plurality of orifices in the top thereof, said orifices being placed along the length of said water tube in corresponding relationship with said opening of said casing, said orifices being grouped in thee distinct groups, one of which is open at all times and the second and third of which are selectably open or closed in response to water flow interruption plungers located upon a cam shaft;

a cam shaft extending longitudinally of and disposed within said casing, said cam shaft including a plurality of rotatable water flow interruption plungers therealong and a plurality of cam surfaces positioned along the longitudinal axis of said casing in corresponding relationship to said second and said third grouping of orifices, each said rotatable water flow interruption plunger being in cooperating relation with and movable in response to positioning of said cam surfaces to selectably permit or interrupt water flow to said orifices;

a generally circular cam dial to rotate said cam shaft to one of several selectable positions each of which actuates one or more preselected rotatable plungers to open or close corresponding preselected orifices, said cam dial being mounted concentric to said casing and in cooperation with said second support housing and connected to one end of said cam shaft, said cam dial rotation being independent of said casing;

a water motor within said first support housing to oscillate said casing, said motor having gears connected to drive means connected to said casing, whereby said casing oscillates in response to water flowing through said water motor; and a hose fitting upon said first support housing to accept a water supply and direct water through said water motor and into said water tube and out of said orifices which are open.

24. The sprinkler of claim 23 wherein said first support housing includes at least one adjustable positioner along the upper periphery thereof, said positioner being in cooperative relationship with said water motor, whereby the position of said positioner determines the extent of oscillation of said casing when water is flowing through said water motor.

25. The sprinkler of claim 23 wherein said first and second support housings are connected at their base portions by one or more stabilizing members extending from the base portion of said first support housing to the base portion of said second support housing.

26. The sprinkler of claim 23 wherein each of said cam surfaces on said cam shaft includes a pair of outer peripheral cam surfaces each having a raised portion and a lower center cam surface having a raised portion disposed between said pair of outer cam surfaces and each of said water interruption plungers includes a pair of outer legs in cooperation with said outer peripheral cam surfaces and a higher central leg disposed between said outer legs and in cooperation with said center cam surface, a central shaft member to maintain alignment of said water interruption plunger with its corresponding cam surface and orifice, and an upper plunger section having a flared stopper for engagement with one said orifice of said water tube, said raised portions of said cam surfaces being arranged so that said center leg and said outer legs of said water interruption plunger are in contact with respective raised portions of said cam surfaces at different radial positions along the periphery of said cam shaft, whereby said plunger is rotated about said central connecting shaft and urged into open relationship with said orifice when said center leg of said water interruption plunger is in contact with said raised portion of said center cam surface and said pair of outer legs of said water interruption plunger is in contact with the non-raised portion of said outer peripheral cam surfaces, and said water interruption plunger is rotated about said connecting shaft and urged into closed water flow interruption relationship when said center leg of said water interruption plunger is in contact with the non-raised portion of said center cam surface and said lower outer legs of said water interruption plunger are in contact with said raised portion of said outer peripheral cam surfaces.

* * * * *